United States Patent [19]

Kite

[11] 4,195,646

[45] Apr. 1, 1980

[54] PROCESS FOR SHREDDING TOBACCO STEMS

[75] Inventor: George F. Kite, Richmond, Va.

[73] Assignee: Philip Morris Incorporated, New York, N.Y.

[21] Appl. No.: 797,705

[22] Filed: May 17, 1977

[51] Int. Cl.[2] ..... A24B 3/00; A24B 5/00

[52] U.S. Cl. ..... 131/140 R; 131/120

[58] Field of Search ..... 131/122, 145, 146, 110, 131/120, 140 R, 140 C, 140 P, 128, 132; 241/199.12, 14, 282.1, 292.1, 73, 18, 189 R, 79.1

[56] References Cited

U.S. PATENT DOCUMENTS

| | | | |
|---|---|---|---|
| 3,032,087 | 5/1962 | Rodwick | 241/282.1 |
| 3,074,653 | 1/1963 | Schorsch | 241/14 |
| 3,141,485 | 7/1964 | Bonner, Jr. et al. | 131/145 |
| 3,175,594 | 3/1965 | Jepson | 241/199.12 |
| 3,204,641 | 9/1965 | Jones | 131/140 P |
| 4,030,865 | 6/1977 | Kobayashi | 241/189 R |

*Primary Examiner*—Robert W. Michell
*Assistant Examiner*—V. Millin
*Attorney, Agent, or Firm*—Arthur I. Palmer, Jr.; George E. Inskeep; Susan A. Hutcheson

[57] ABSTRACT

A process for shredding tobacco stems into fibrillar stem fragments by striking stem shards protreptically against the inertia thereof while in dynamic suspension.

5 Claims, 5 Drawing Figures

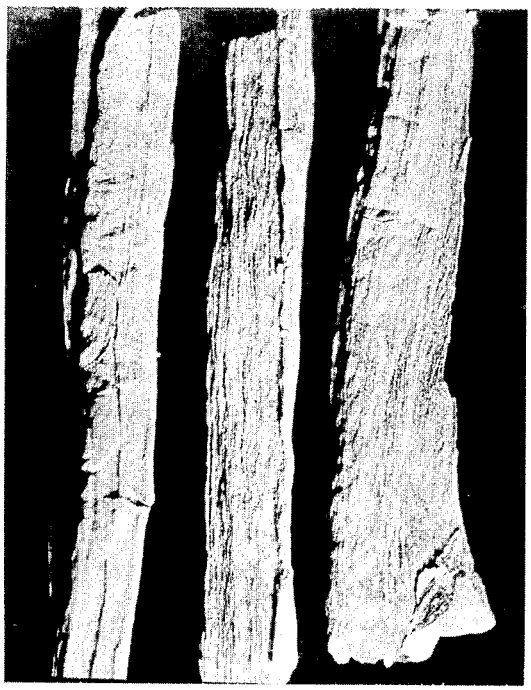
FIG. 4 BURLEY STEMS 4X MAG.
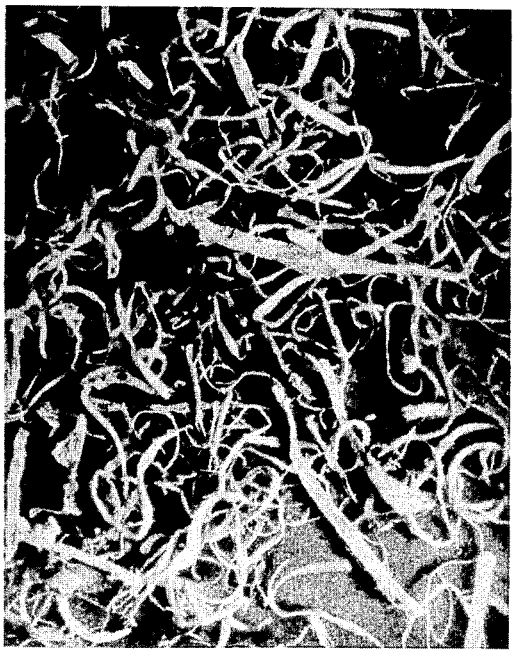
FIG. 5 FINISHED PRODUCT 4X MAG

PROCESS FOR SHREDDING TOBACCO STEMS

BACKGROUND OF THE INVENTION

The processing of tobacco stems has been complicated in the past because of the structural dissimilarity of the rod-like stems in comparison with the laminar portions of the tobacco leaf. The sheet-like quality of the laminar portions results in a resilient curliform shred when cut. Such shreds of laminar material, when agglomerated, result in a cigarette filler material which exhibits predictable qualities of filling power, density, and texture. These qualities derive from the tortuous configuration and springiness of individual shreds which curl and otherwise arrange themselves in convoluted patterns. Such shreds exhibit enough springiness so that the total filling capacity of a cigarette filler in which they appear is enhanced. These characteristics of cigarette fillers containing laminar leaf shreds are the focus around which the elements of cigarette making machinery design have developed.

Cigarette making machines incorporate a high degree of automation capability. They are designed to accept and handle tobacco filler having particularly those characteristics described above which are peculiar to cut leaf blend. Any significant departure from these characteristics may make a cigarette filler blend unsuitable for proper feeding into automatic cigarette making equipment. Blends of cigarette filler which contain a mixture of shreds cut from leafy material and from stems wherein the cut stem content is proportionately above a certain level may not be a suitable feed material for such machines. When the percentage of cut stem shreds is too high, problems may be experienced in the operation of the equipment's tobacco filler feed mechanism. There may also be produced a certain excessive percentage of cigarettes which are rejected because of improper appearance or feel.

The basic problem arises from the dense texture of those stem shreds which are produced when cut across the grain of the stem shards according to methods of shredding widely used in tobacco cutting machinery. As stated, leaf shreds exhibit resiliency; while stems, when cut across the grain under like conditions, may produce stick-like shreds or hard chunks of relatively high density. These hard stick-like shreds and chunks are less suitable as cigarette filler constituents. In addition, the relatively short length and lack of springiness of cut stems reduces their contribution to blend filling power and increases their tendency to separate from the blend on handling. It is desirable to carry out stem processing in such a way as to produce stem shred fragments which more nearly duplicate the texture of leaf shreds.

Some prior art stem shredding methods have been used in an attempt to convert stems into such leaf-like fragments which would be compatible with leaf shreds in a filler mixture blend. Some progress has been made toward this objective by rolling the stems under pressure between pressure rolls. Thus, the stems are crushed, flattened, macerated, and otherwise modified in overall structure prior to shredding. This process, known as "rolling and cutting," is a current industry standard.

In such a process, threshed bright and/or burley stems are moistened to 25 to 35% moisture content and then passed between press rolls to flatten the stems to a form more like leaf lamina. These flattened stems are then cut into shreds on a tobacco cutter and reordered to a moisture content suitable for blending with other tobacco filler components.

Methods such as the above have produced stem shreds of varying acceptability. The physical form and appearance of the shreds so produced has resulted in inconsistent quality and yields. This lack of consistency has limited the ready use of stems in spite of the present need to increase the percentage of stem shred fragments in the make-up of filler blends. In addition, some undesirably large stem particles are produced which cannot be recycled to the process of rolling and cutting.

To the end that stem shreds be made more like leaf shreds in appearance and texture, it has been suggested that a new and different stem shredding process be devised. More particularly, it is desired to shred tobacco stems in such a way as to cause the stems to separate into fragments of curliform fibrous strands.

SUMMARY OF THE INVENTION

An object of the present invention is to shred tobacco stems by splitting or parting the stems along the grain to produce light, pliable, low bulk density fibrillar shreds. Such shreds exhibit sufficient resiliency so that when massed they approximate or exceed the filling capacity of cut leaf shreds. Rolled and cut stem shreds tend to separate out on handling, while fibrilliform stem fragments of the present invention when mixed with leaf shreds counter this tendency toward separation.

The present process utilizes blunt rotatable blade-like elements as hammers used to strike stem shards. Such blades are arranged to revolve at high speed within a moving stream of fluid-supported, dispersed, water-softened tobacco stem shards. The blunt blades travel at very high velocity within the stream of softened shards and strike the individual shards with force sufficient to cause spalling of the shards into fibers parting them along the grain of the stem to produce long fibrous shred fragments.

The shards to be shredded are first wetted to a given desired moisture content. Wetting makes the shards pliable and avoids the production of an excessive number of short fibers. The shredding through spalling action, according to the present invention, is thought to result from impingement of the fast-moving blunt blades on the floating stems and stem shards by converting kinetic energy into internal stem energy on impact thereby causing shattering of the shards along the lines of the internal grain structure. This forms elongated fibrous shreds which are thence driven protreptically forward of the blades by the transfer of kinetic energy. They are thus repositioned to be struck again and again by succeeding blades. This action proceeds until the repeated spalling results in producing finer and finer shreds until the desired degree of fineness results. These fine fibrillar shreds are then separated and removed as a finished product by screening, air classification, or centrifugal force. In this way, the stem shards are not exposed to a tearing or cutting action resulting from contact with opposing surfaces while under violent protreptic movement induced by blade action.

Long, light fibrous shreds are thus produced which exhibit the desirable characteristics of resilience similar to shreds cut from leaf tobacco. In addition, they possess the characteristic of forming into helical convolutions thought to be the result of dissimilar inherent strains in the shard structure in its natural state, thus imparting springiness to the shreds for better filling power and curliness better to cause the stem shreds to intertwine with leaf shreds in a blend.

In contrast, as previously indicated, stem shreds made according to the prior art in a rolling process and cut by opposed shearing elements tend to exhibit undesirable features. Such features are short shred length, a high degree of hardness, and high bulk density which in each case results in lower filling power and poorer blendability with shredded leaf in cigarettes. However, the shreds produced by the present process possess improved cigarette filling power per unit of weight over shreds produced by these former methods and exhibit greater resilience and subjectively produce a cigarette which has a smoother feel.

An important aspect of the process of the present invention is that the stems and stem shards are resiliently supported in a fluid medium against impact action of the blades. An "anvil-type" chopping block support for the shards or a shearing or cutting action by a traveling cutter blade against a rigid support is avoided in the present process which effects shredding and fiberizing by spalling action through the transfer of kinetic energy at the point of collision between a blade and a floating stem fragment. This results in explosive spallation and produces an unexpectedly superior fibrous shredded stem product which is better suited for use in cigarette filler combinations than shreds produced by prior methods.

DESCRIPTION OF THE DRAWINGS

FIG. 4 is a photograph of feed stock of stem shards.

FIG. 5 is a photograph showing the finished product of the present process.

DESCRIPTION OF THE PRESENTLY PREFERRED PRACTICES OF THE INVENTION

In accordance with the present invention, stem midribs separated from a tobacco leaf in any satisfactory way are first treated with water in such a manner as to thoroughly moisten the stems uniformly throughout. This moistening step may be effected by spraying, steaming, or immersing the stems in a water bath for a period of time as needed to achieve the desired level of moisture content. Moistening of the stems by subjecting the stems to the action of steam within a pressure vessel or at ambient pressures will result in accelerating the penetration of moisture into the stems.

Regardless of the method chosen to moisturize the stems, it is desired to bring the moisture content to a level of from 40 to 75% with a preferred level being at least about 60% by weight, wet basis. A significantly lower moisture content will cause the production of an undesirable percentage of short shreds due to brittleness of the tobacco in the drier state.

Figure 1:
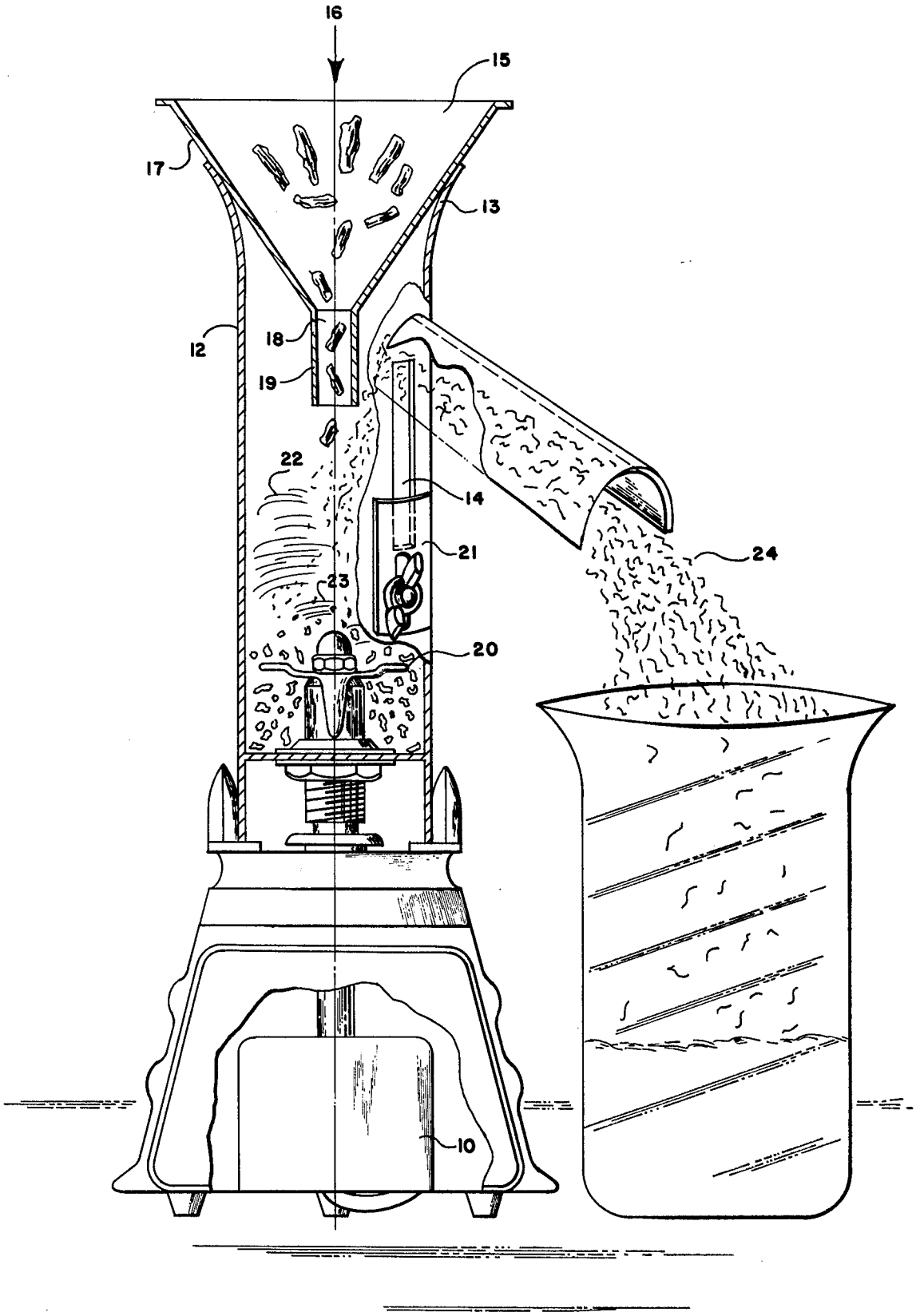
FIG. 1 is a Waring Blendor illustrated to show modification for adaptation to the present process.

The stems, after moistening, are introduced at a given rate of feed into a partially confined area in which striker blades are arranged to rotate at high speeds in accordance with the modes of the invention as hereinafter described. The moistened stems are shredded in the practice of one mode of the present invention in a specially adapted one-quart Waring Blendor as shown in FIG. 1 equipped with a commercial electric motor 10 and a bowl 12 in which the wall 13 has been provided with an exit slot 14 as shown in FIG. 1. A funnel-like feeder 15 is positioned within the steel bowl 12. The feed material 16 consists of tobacco stem shards which have been prepared by any suitable means (not shown) to a desired length known as "short stems" and preferably 1 to 3 inches in length prior to entry into the upper cone-like feed section 17 of the funnel 15. In operation, the shards 16 are fed by hand or mechanically into the funnel 15 at a suitable rate thence through the upper end 18 of the feed tube 19.

The blade element 20 is rotated at approximately 21,000 revolutions per minute by means of a standard Waring Blendor motor 10. Shards are thus thrust centrifugally outward and accelerated forwardly, recirculated, and struck again repeatedly. A fresh supply of shards is fed through the funnel 15 until an equilibrium rate of feed of material entering at that point is matched to the effluent rate of finished product exited through the slot 14. The gate element 21 is adjusted to a height of closure in slot 14 to control the depth of material in proximity to the blade 20. This determines the fineness of the shreds which are forced to the top of the torus 22 formed around the vortex 23 over the blade 20. The recirculation time of the shards and shreds within the vortex 23 determines the fineness and final curliform characteristics in the completed shreds.

Thus, factors in controlling the fineness of the shreds are the rate of feed of the shards and the height of the lower end of the exit slot 14. This maintains the depth of the shards in proximity to the revolving blades which in combination with the rate of feed of fresh shards through the feed funnel 15 is critical in determining the degree of fineness of finished shreds discharged at the effluent slot 14. Once the balance of feed rate and height of the effluent slot are determined, the process may be carried on continuously with fresh stem shards 16 being fed through the feed funnel 15 at a desired rate consistent with the rate of effluent 24 of finished shreds as described above.

The wide mouth funnel 15 as fitted to the jar top of the bowl 12 facilitates continuous addition of feed stems and performs the additional function of preventing stem shards and product from being ejected from the top of the jar by the force of blade impact.

During operation, threshed stems, softened by moistening to 40 to 75% moisture content, preferably above 60%, and holding or "bulking" 1 to 24 hours, preferably 1 to 2 hours, are added through the funnel 15 at a rate determined by the rate of shredded stem efflux through the slot 14 for a given preset height of the gate element 21. The blade 20, as driven by the blendor motor 10 at about 21,000 revolutions per minute, shatters the stems into finer and finer fragments on recirculation within the torus 22. The shards and shreds in the rotating vortex 23 are supported above the shredding zone by air and centrifugal forces. Thus, as a suitable size and shape of shred is attained, they rise to the top of the torus 22 being carried upward by support of surrounding movement of air exiting by centrifugal action through slot 14. Larger stem shards remain in the shredding zone until they are shattered into lighter fragments and become air supportable at the upper part of the torus for removal. The height of the bottom edge of the sidewall slot 14 is adjusted vertically by repositioning of the gate element 21 to a height to permit an optimum size, shape, and weight range of shredded stems to exit the bowl according to their relative position in the circulating torus of finished product.

The product removed through the slot 14 may be further separated (i.e., with a standard or preferably a slotted classifying screen, by centrifugal force or by air classification) and dried to a moisture content suitable for incorporation in a cigarette blend.

Oversized material which remains after screening on a slotted classifying screen, not shown, may be recycled alone, directly to the blendor, or mixed with fresh stem feed. Thus, no oversized material ultimately remains by this mode of the process. The final product is composed totally of suitable filler and a small amount of fines which are separated for use elsewhere.

Figure 2:
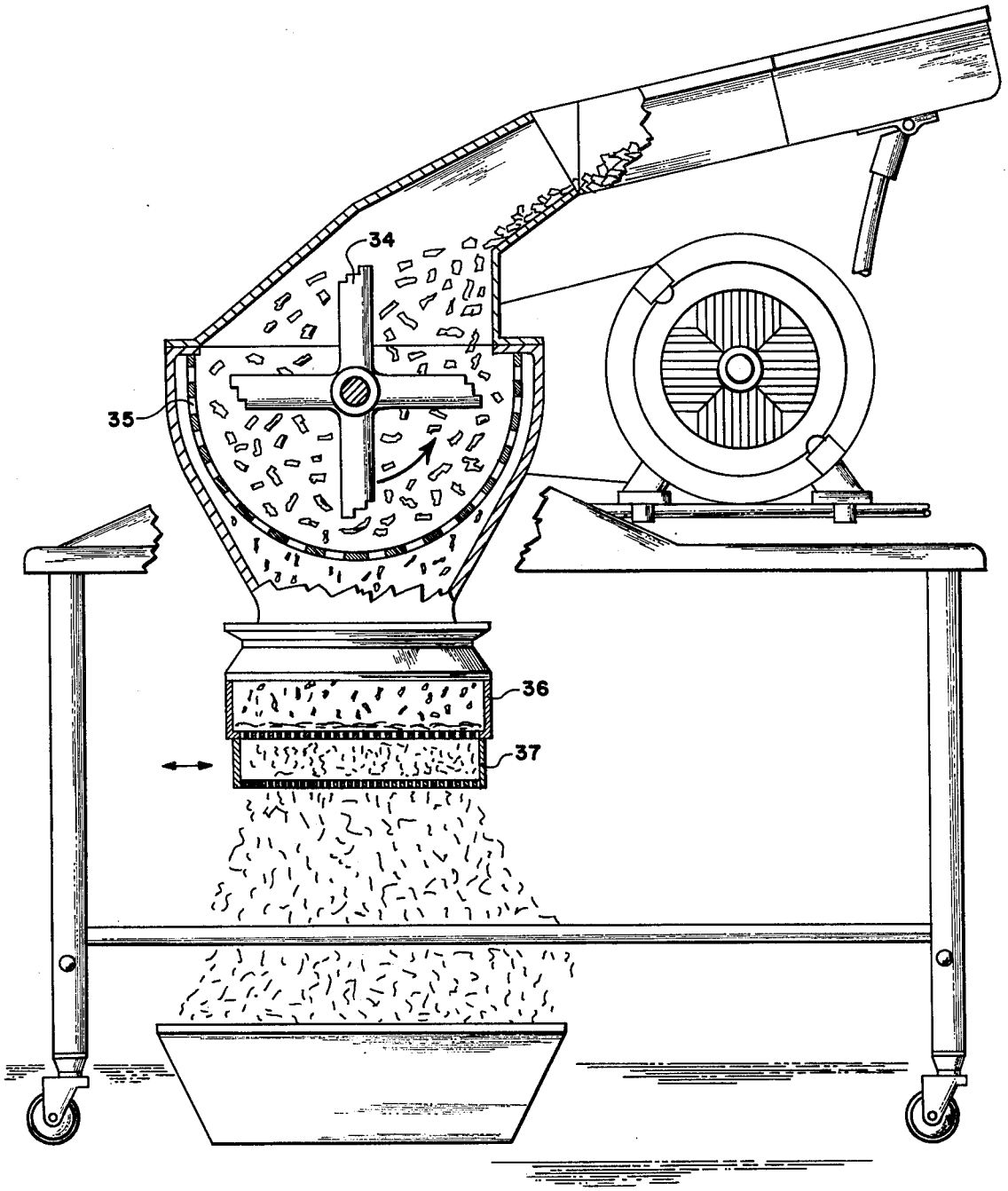
FIG. 2 is a view in elevation showing a blade arrangement of a typical hammermill and screening apparatus; i.e., a Fitzmill and a Sweco vibrating screen.
Figure 3:
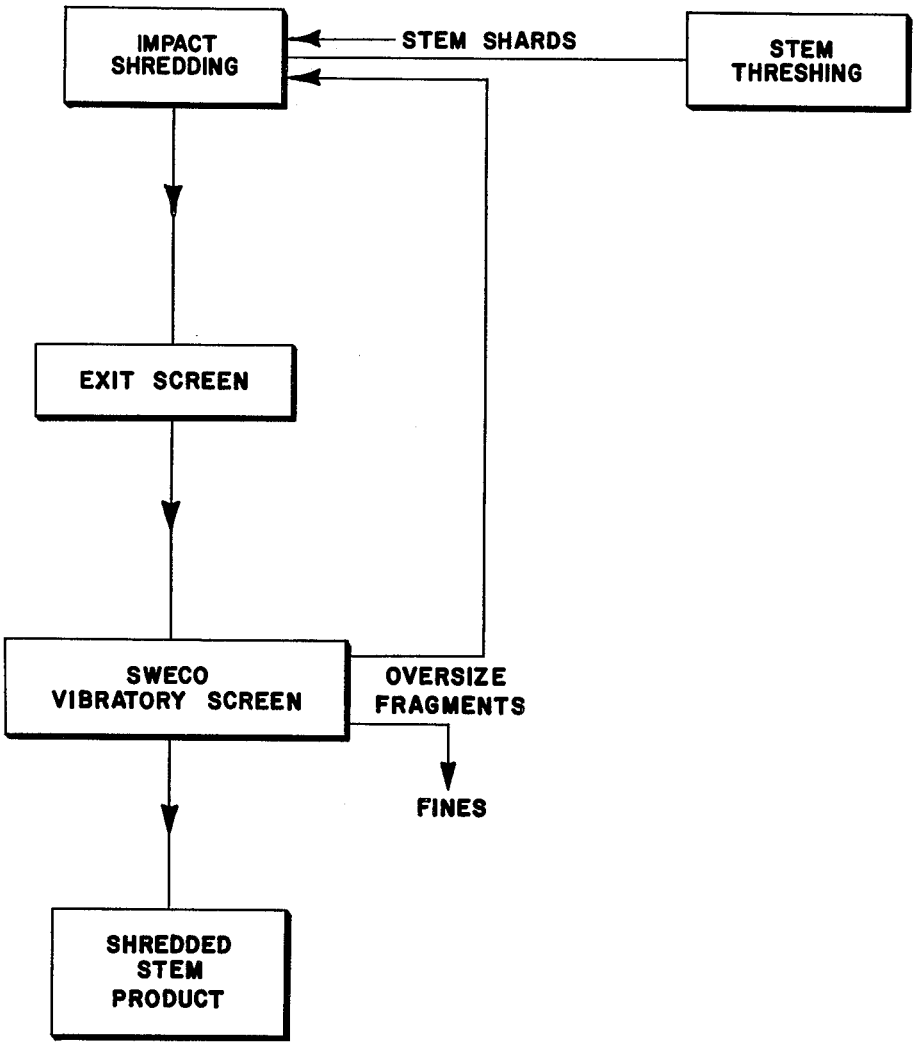
FIG. 3 is a diagrammatic showing of the related steps of the process.

An alternate form of the present process may be implemented with a Model M Fitzmill as shown in FIG. 2 which is fitted with blunt-faced impact blades 34 and a 4-mesh exit screen 35. The particular unit is manufactured by The Fitzpatrick Company of Elmhurst, Ill. Threshed stems, softened by moistening to 40 to 75% moisture content, preferably above 60%, and then holding or "bulking" for 1 to 24 hours, preferably 1 to 2 hours, are submitted to the shredding zone of the Fitzmill at a rate which permits free circulation of the stems and ready access to spalling thereof by the rapid rotation of blades 34. The shredding mass of stems is forced by centrifugal action against the exit screen 35. As size and shape permit, the shredded stem fragments go through the screen 35.

The crude shredded stem shards after passing through screen 35 are further separated from the finer shreds on a two-deck classifying screen assembly containing a suitably sized slotted upper screen 36 which may have slots ranging in size from $1\frac{1}{2}'' \times \frac{1}{4}''$ to $1'' \times 1/16''$ and a regular 30-mesh lower screen 37. Those stem shards remaining on the upper slotted screen 36 are called "heavies" and are recycled to the hammermill, either alone or in admixture with fresh stem feed. The fraction retained on the 30-mesh screen 37 is the product desired and is thereafter dried to a moisture suitable for cigarette blends. The smaller stem particles which pass through the 30-mesh screen 37 are not recycled to the mill. These are called fines and are carried away for use elsewhere. Thus, only suitable product and fines are produced in this process with the "heavies" being recycled.

EXAMPLE 1

Batch Waring Blendor Shredding

A standard one-quart glass Waring Blendor bowl is equipped with a lid and a standard blade set of four blades and is powered by a commercial two-speed motor, Model 5011, 21,000 RPM, as illustrated in FIG. 1.

Threshed burley tobacco stem shards up to approximately three inches in length are softened by moistening to over 60% moisture content and held or "bulked" for one hour in a sealed container. The softened stems are Waring Blendor shredded in 10 g batches for 30 seconds each.

A fraction of the shredded product which passes through a standard Sweco 4-mesh screen and retained on a 30-mesh Sweco screen is dried and equilibrated under standard conditions in air of 60% relative humidity at 75° F. The shredded stems so equilibrated exhibit a cylinder volume of 92 cc for a weight of 10 g at 12.6% OV (oven volatiles) compared to burley stems prepared by the usual rolling and cutting process which exhibit a cylinder volume of 49 cc for a like weight with 12.5% OV.

EXAMPLE 2

Continuous Waring Blendor Shredding

A standard one-quart metal Waring Blendor bowl as illustrated in FIG. 1 is equipped with a vertical rectangular slot of $1 \times 3$ inches in one side wall and provided with a height adjustable bottom edge by means of an adjustable closure. The bowl is also fitted with a standard blade set and a wide mouth plastic funnel and is powered by a standard commercial two-speed motor, Model 5011, which is capable of turning at 21,000 RPM, as shown in FIG. 1.

Threshed burley stems of up to 3 inches in length are softened by moistening to 65% $H_2O$ and holding for one hour in a sealed container. The softened stems are added slowly at the rate of 5 to 10 g per minute through the funnel 15, and the bottom edge of the slot 14 is height adjusted by gate element 21 to permit exit of a subjectively optimum fraction of shredded stems.

A fraction of the product produced as passed through a standard Sweco 4-mesh screen and as further retained on a 30-mesh Sweco screen is dried and equilibrated under standard conditions. The shredded stems thus treated exhibit a cylinder volume of 90 cc per 10 g of weight at 12.5% OV compared to burley stems prepared by the usual rolling and cutting process which exhibit a cylinder volume of 49 cc per 10 g of weight at 12.5% OV.

The fraction of heavies of shredded stems retained on the 4-mesh screen is mixed with fresh feed and recycled through the Blendor. Ultimately, the process gives a 92% yield of product which is retained on a 30-mesh screen.

EXAMPLE 3

Fitzmill Shredding Utilizing a 4-Mesh Exit Screen

A Model M Fitzmill equipped to turn at 5,000 RPM is equipped with blunt impact blades of Type D-625 and a 4-mesh exit screen, Type A, No. 4, as shown in FIG. 2.

Threshed burley stems of up to three inches in length are softened by moistening to above 60% moisture and held for one hour in a sealed container. The softened stems are passed through the Fitzmill at about five pounds per hour.

A fraction of the crude shredded stems passing through a slotted Sweco screen with openings of $1\frac{1}{4} \times 3/32$ inches and retained on a regular 30-mesh Sweco screen is dried and equilibrated under standard conditions. The shredded stems exhibit a cylinder volume of 70 cc per 10 g of weight at 12.5% OV compared to 49 cc per 10 g of weight at 12.5% OV for burley stems prepared by the usual rolling and cutting process.

The fraction retained on the slotted Sweco screen consisting of the "heavies" of shredded stems is mixed with fresh feed and recycled through the Fitzmill. This process gives a 90% yield of usable product through a slotted 4-mesh screen and retained on a 30-mesh screen with a 10% yield of fines which pass through the 30-mesh screen and are removed for use elsewhere.

EXAMPLE 4

Fitzmill Shredding with ½-Inch Exit Screen

The process of Example 3 is performed except that a Fitzmill exit screen with ½-inch round holes is used. Very little shredding action takes place due to the rapid exit of the stems from the vicinity of the rotating blades.

EXAMPLE 5

Fitzmill Shredding with 8-Mesh Exit Screen

The process of Example 3 is performed except that a Fitzmill exit screen with round holes of 8-mesh is used. The crude product exiting the Fitzmill under these conditions is very finely divided with a high proportion of dust and undesirable fines due to an excessive time spent in contact with the rotating blades.

EXAMPLE 6

Fitzmill Shredding with a Regular 4-Mesh Classifying Screen

The process of Example 3 is performed except that a (Square hole) 4-mesh size classifying screen is used for separation of the recycle stream of "heavies" from the usable shreds. The recycle stream of heavies is found to contain a relatively large proportion of desirable shreds. The product passing through this 4-mesh screen and retained on a 30-mesh screen also contains some undesirable flat rectangular stem chips.

EXAMPLE 7

Batch Waring Blendor Shredding with Bright Stems

The process of Example 1 is performed with bright stems at above 60% moisture content replacing the burley stems. The product passing through a 4-mesh and retained on a 30-mesh screen has a cylinder volume of 45 cc per 10 g of weight at 12.5% OV compared with 36 cc per 10 g of weight at 12.5% OV for bright stems prepared by the usual rolling and cutting process.

EXAMPLE 8

Fitzmill Shredding with Bright Stems

The process of Example 3 is performed with bright stems at above 60% OV replacing the burley stems. The passing through a 4-mesh onto a 30-mesh product fraction had a cylinder volume of 43 cc per 10 g of weight at 12.5% OV compared with 36 cc per 10 g of weight at 12.5% OV for bright stems prepared by the usual rolling and cutting process.

Additional Comments and Discussion

In FIG. 4, a photograph of typical feed stock at 4 times magnification shows stem shards which have been prepared for processing in accordance with the invention by treatment in a preliminary threshing step. The finished shreds are shown in FIG. 5 and are photographed in equal magnification to that of FIG. 4.

It can be seen that in FIG. 5, the shreds are of very fine strand thickness and are lying in curliform convoluted patterns of somewhat helical nature. Such shreds exhibit spring-like qualities and intertwine readily with tobacco leaf shreds.

Since the moisture content of the finished shreds is similar to that of the feed stem shards, these shreds are dried to a reordered moisture content of 12.5%; and the "cylinder volume," which is a means for gauging the ability of a particular cigarette filler product to pack a cigarette to a desired firmness, is evaluated by way of reading the height of stem shred product produced by different methods in columns of equal weight within a standard graduated cylinder under a standard pressure.

In this way, a test for filling power is made. The same amount of pressure in the form of a weighted piston with small clearance within the cylinder is placed at the top of the samples in each case, and the height of the tobacco column in the cylinder under the piston is observed after it has been weighted for a suitable time interval. The following relative volumes of stem shreds made by the different methods is as shown in the representative comparisons in Table 1 below.

Table 1

| | Representative Cylinder Volume for Processed Stems | At 12.5% OV |
|---|---|---|
| 1. | Rolled and cut bright stems | 33 cc/10 g |
| 2. | Shredded bright stems "Fitzmill" | 43 cc/10 g |
| 3. | Rolled and cut burley stems | 49 cc/10 g |
| 4. | Shredded burley stems "Fitzmill" | 70 cc/10 g |

The data of Table 1 demonstrate that the present process yields a product of greatest filling power when applied to the shredding of burley stems. However, both bright and burley stems when shredded in accordance with the present process are produced at lower cost and with the elimination of several processing steps in comparison with prior art methods. In the case of burley stems, which are the most difficult to process by prior methods, there is a large increase in filling power as is shown in Table 1 when shredded according to the present invention.

The process of the present invention makes possible the conversion of stems of both flue-cured and air-cured tobacco into a usable blending component for cigarette filler. The final product in the form of fibrillar stem shreds is very well suited for use in cigarette filler blends and offers considerable economic advantages. Moreover, a high capital investment is not required for the process which can be carried out using readily available equipment.

While presently preferred embodiments and practices of the invention have been described, it will be apparent that the invention may be otherwise variously embodied and practiced within the scope of the following claims.

What is claimed is:

1. A method of shredding tobacco stems by splitting or parting the stems lengthwise along the grain thereof to produce light, pliable, low bulk density fibrillar shreds which comprises the steps of:

a. having tobacco sten shards supported by a fluid medium which defines a shredding zone; and b. striking said stem shards with a blunt instrument, while so supported, with sufficient force to separate said stem shards into fibrilliform shred fragments.

2. The method of claim 1 utilizing a free blade device having blunt blades.

3. The method of claim 1 further comprising the steps of:

a. preselecting a set of physical characteristics desired for said separated fibrils; and b. continuously removing fibrils from said shredding zone as they reach the said desired preselected physical characteristics.

4. The method of claim 3 wherein said continuous removal of fibrils is based upon the supportability thereof at a preselected level in a torus of air relatively of the level of the surrounding material within said torus.

5. The method of claim 3 wherein said set of physical characteristics includes preselected maximum or minimum fibrillar shred sizes.

* * * * *